US012240510B2

(12) United States Patent
Takeuchi et al.

(10) Patent No.: US 12,240,510 B2
(45) Date of Patent: Mar. 4, 2025

(54) TRAIN EQUIPMENT MANAGEMENT SYSTEM, INFORMATION COLLECTION APPARATUS, AND GROUND SYSTEM

(71) Applicant: Mitsubishi Electric Corporation, Tokyo (JP)

(72) Inventors: Takeshi Takeuchi, Tokyo (JP); Satoshi Kaede, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 235 days.

(21) Appl. No.: 17/271,025

(22) PCT Filed: Sep. 7, 2018

(86) PCT No.: PCT/JP2018/033304
§ 371 (c)(1),
(2) Date: Feb. 24, 2021

(87) PCT Pub. No.: WO2020/049739
PCT Pub. Date: Mar. 12, 2020

(65) Prior Publication Data

US 2021/0316771 A1 Oct. 14, 2021

(51) Int. Cl.
*B61L 25/04* (2006.01)
*B61L 27/00* (2022.01)

(52) U.S. Cl.
CPC ..... *B61L 25/04* (2013.01); *B61L 27/00* (2013.01)

(58) Field of Classification Search
CPC ..... B61L 25/04; B61L 27/00
See application file for complete search history.

(56) References Cited

U.S. PATENT DOCUMENTS

2016/0016596 A1 1/2016 Naylor
2016/0272228 A1 9/2016 Lefebvre et al.
(Continued)

FOREIGN PATENT DOCUMENTS

JP H0872720 A 3/1996
JP 2012048287 A 3/2012
(Continued)

OTHER PUBLICATIONS

Extended European Search Report dated Aug. 16, 2021, issued in corresponding European Application No. 18932663.0. (9 pages).
(Continued)

*Primary Examiner* — Adam D Tissot
(74) *Attorney, Agent, or Firm* — BUCHANAN, INGERSOLL & ROONEY PC

(57) ABSTRACT

A train equipment management system includes an information collection apparatus that collects individual identification numbers for identifying devices from identification tags attached to the devices installed in a train, collects device operation information indicating an operating condition of each device, and transmits, for each device, the individual identification number, the device operation information, a car number for identifying a car in which each device is installed, and a formation number for identifying the train, to a ground system; and the ground system that manages the formation number, the car number, and the device operation information in association with the individual identification number of each device.

13 Claims, 12 Drawing Sheets

(56) References Cited

U.S. PATENT DOCUMENTS

| | | | | |
|---|---|---|---|---|
| 2017/0176287 | A1* | 6/2017 | Ito | F16C 19/52 |
| 2017/0305448 | A1* | 10/2017 | Yano | G06F 30/20 |
| 2019/0144021 | A1* | 5/2019 | Yoshimoto | B61L 15/0072 701/29.6 |

FOREIGN PATENT DOCUMENTS

| | | | |
|---|---|---|---|
| JP | 2017088024 | A | 5/2017 |
| WO | 2016039202 | A1 | 3/2016 |

OTHER PUBLICATIONS

Office Action (Notice of Reasons for Refusal) issued on Jul. 20, 2021, in corresponding Japanese Patent Application No. 2020-540986 and English translation of the Office Action. (7 pages).

Office Action dated Mar. 16, 2021, issued in corresponding Japanese Patent Application No. 2020540986, 8 pages including 5 pages of English translation.

International Search Report (PCT/ISA/210) with translation and Written Opinion (PCT/ISA/237) mailed on Nov. 27, 2018, by the Japan Patent Office as the International Searching Authority for International Application No. PCT/JP2018/033304.

Office Action dated Jan. 25, 2022, issued in corresponding Indian Patent Application No. 202127008069, 8 pages.

Communication pursuant to Article 94(3) EPC dated Oct. 6, 2023, issued in the corresponding European Patent Application No. 18932663.0, 8 pages.

Office Action dated Jun. 21, 2024, issued in the corresponding Indian Patent Application No. 202127008069, 3 pages.

* cited by examiner

TRAIN EQUIPMENT MANAGEMENT SYSTEM, INFORMATION COLLECTION APPARATUS, AND GROUND SYSTEM

FIELD

The present invention relates to a train equipment management system, an information collection apparatus, a ground system, and a train equipment management method.

BACKGROUND

A plurality of devices is installed in each car included in a train. When a failure occurs in a device, it may be useful in identifying the cause of the failure if it is known what kind of train the failed device was actually used in and what kind of train operation the failed device was used for. However, in the case where a device installed in a car is removed for repair, maintenance, or the like, the device may not be returned to the original car. In addition, when train formation is changed, the relative position of each car may be changed in the train formation. Currently, individual information for identifying individual devices installed in a car is not managed. Therefore, it has not been possible to determine what kind of train a device was used in and what kind of train operation the device was used for.

Patent Literature 1 discloses a technique for managing histories of a plurality of machine tools in which consumable parts are used, accumulated hours of use, and the like, by attaching a radio frequency identifier (RFID) tag to each consumable part, and writing a usage history to each RFID tag when the consumable parts are attached to the machine tools.

CITATION LIST

Patent Literature

Patent Literature 1: Japanese Patent Application Laid-open No. 2012-48287

SUMMARY

Technical Problem

However, many devices are installed in a train. When the technique described in Patent Literature 1 is applied to a train, there has been a problem that it is difficult to apply the technique described in Patent Literature 1 to a railroad car, which is used for decades, in the case where an RFID tag is attached to each device installed in the train and a usage history is surely written to each RFID tag attached to each device. This is because the recording area of the RFID tag is limited.

The present invention has been made in view of the above, and an object of the present invention is to obtain a train equipment management system capable of managing usage histories of devices installed in a train.

Solution to Problem

In order to solve the above-described problem and achieve the object, a train equipment management system according to the present invention includes: an information collection apparatus to collect individual identification numbers for identifying devices from identification tags attached to the devices installed in a train, collect device operation information indicating an operating condition of each device, and transmit, for each device, the individual identification number, the device operation information, a car number for identifying a car in which each device is installed, and a formation number for identifying the train, to a ground system; and the ground system to manage the formation number, the car number, and the device operation information in association with the individual identification number of each device.

Advantageous Effects of Invention

According to the present invention, a train equipment management system has the effect of enabling management of usage histories of devices installed in a train.

DESCRIPTION OF EMBODIMENTS

Hereinafter, a train equipment management system, an information collection apparatus, a ground system, and a train equipment management method according to an embodiment of the present invention will be described in detail with reference to the drawings. Note that the present invention is not limited to the embodiment.

Embodiment.

Figure 1:
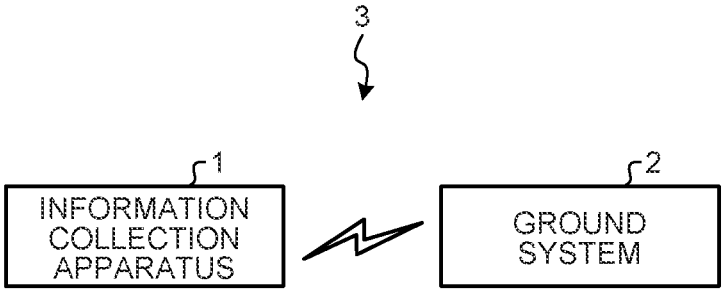
FIG. 1 is a diagram illustrating a configuration example of a train equipment management system.

FIG. 1 is a diagram illustrating a configuration example of a train equipment management system 3 according to an embodiment of the present invention. The train equipment management system 3 includes an information collection apparatus 1 and a ground system 2. The information collection apparatus 1 is installed in a train, and collects an individual identification number and device operation information. The individual identification number is information for identifying a device that is an on-board device installed in the train. The device operation information is information indicating an operating condition of the device. The individual identification number is, for example, the serial number of the device. The device operation information includes, for example, a record of a control signal of the device and a value output from the device, but is not limited thereto. Various types of information can be used as the device operation information as long as the information is to be used for analyzing operation of the device, such as an intermediate calculation value calculated by the device. The information collection apparatus 1 transmits, to the ground system 2, the individual identification number, the device operation information, a car number, and a formation number, for each device. The car number is information for identifying a railroad car in which each device is installed. The formation number is information for identifying the train. Note that in the following description, a railroad car is simply referred to as a car. The ground system 2 acquires the individual identification number, the device operation information, the car number, and the formation number from the information collection apparatus 1. The ground system 2 manages the formation number, the car number, and the device operation information in association with the individual identification number of each device. Note that FIG. 1 illustrates the single information collection apparatus 1 connected to the single ground system 2 as an example, while the ground system 2 can be connected to a plurality of the information collection apparatuses 1.

Figure 2:
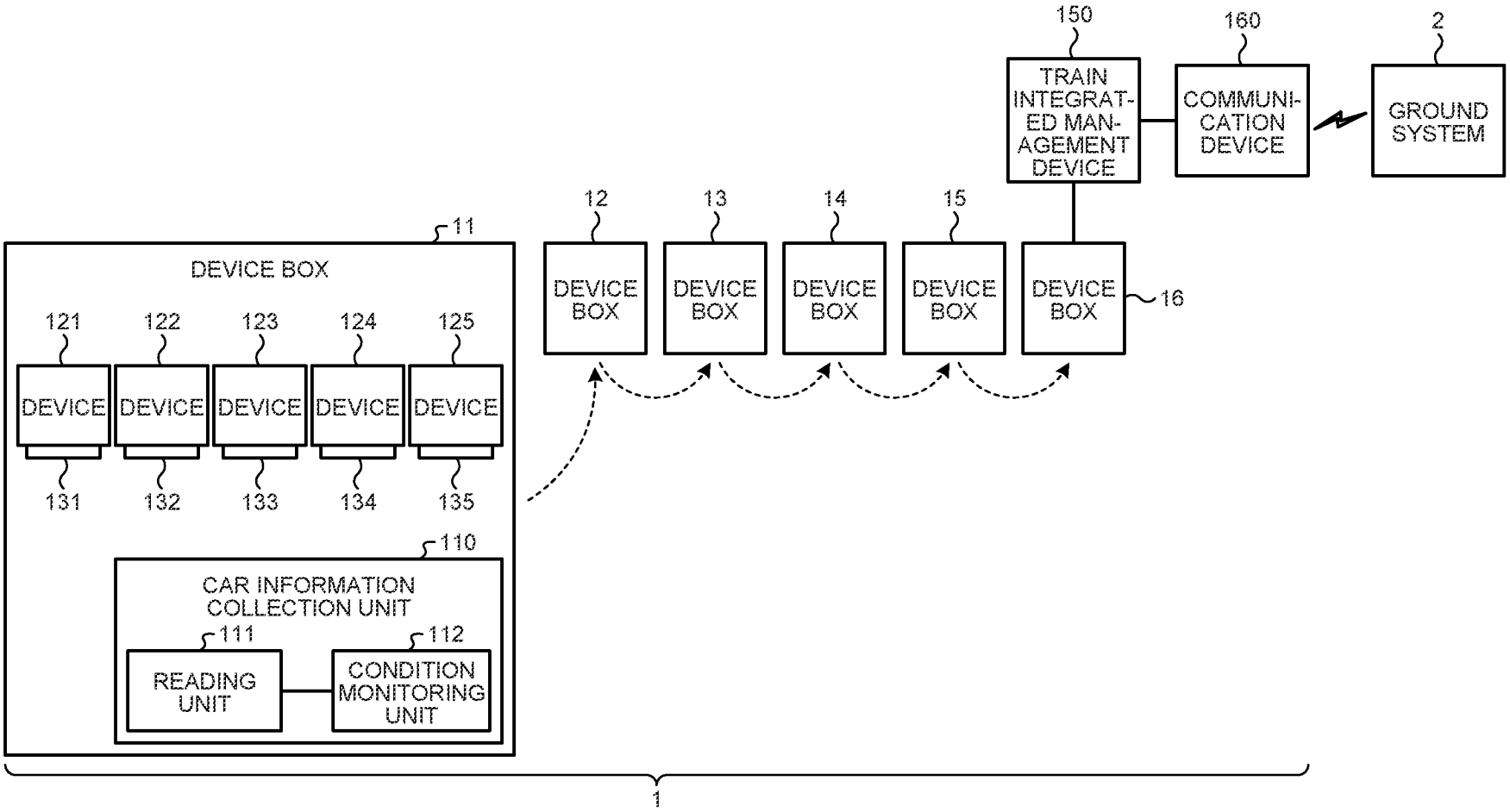
FIG. 2 is a block diagram illustrating a configuration example of an information collection apparatus.

The configuration of the information collection apparatus 1 will be described. FIG. 2 is a block diagram illustrating a configuration example of the information collection apparatus 1 according to the present embodiment. The information collection apparatus 1 includes a plurality of car information collection units 110 each included in device boxes 11 to 16, a train integrated management device 150, and a communication device 160. Although not illustrated in FIG. 2, the device boxes 11 to 16 each include the car information collection unit 110 having the same configuration, while the types, numbers, and the like of devices included in the device boxes 11 to 16 differ between the device boxes 11 to 16.

Figure 3:
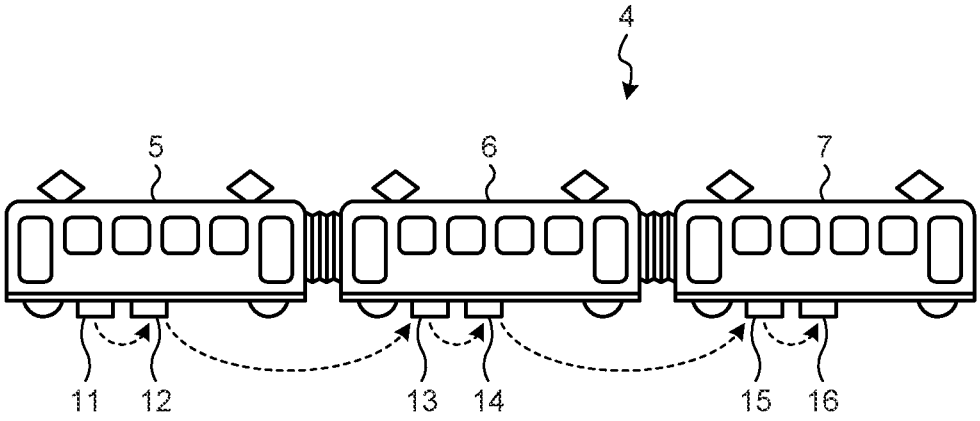
FIG. 3 is a diagram illustrating an example of attaching device boxes to a train.

The device boxes 11 to 16 are each attached to a corresponding car of the train. FIG. 3 is a diagram illustrating an example of attaching the device boxes 11 to 16 to a train 4 according to the present embodiment. FIG. 3 illustrates an example in which two device boxes are attached under the floor of each of cars 5 to 7 included in the train 4. The single train includes the cars 5 to 7. Note that the number of cars to be included in the train 4 is not limited to three. In FIG. 2, the device box 11 includes the car information collection unit 110, devices 121 to 125, and identification tags 131 to 135 attached to the respective devices. The car information collection unit 110 includes a reading unit 111 and a condition monitoring unit 112.

The devices 121 to 125 are on-board devices installed in the car. Each of the devices 121 to 125 may be an independent device, or may be a part or the like included in a single device. Examples of the devices 121 to 125 include a brake, a variable voltage variable frequency (VVVF) inverter, a protective device, and a static inverter (SIV). Alternatively, in the case where a device including the devices 121 to 125 is a brake, a VVVF inverter, a protective device, an SIV, or the like, the devices 121 to 125 may be parts, electronic substrates, modules, and the like.

Individual identification numbers for identifying respective devices to which the identification tags 131 to 135 are attached are stored in the identification tags 131 to 135. The identification tags 131 to 135 are, for example, wireless tags. The wireless tag is, for example, an RFID tag. Note that the identification tags 131 to 135 are not limited to wireless tags, and two-dimensional codes or the like may be used as long as the codes can be read by the single reading unit 111 in the device box 11. For example, when the devices 121 to 125 are manufactured, the individual identification numbers, that is, serial numbers of the devices 121 to 125 are stored in the identification tags 131 to 135, respectively, and the identification tags 131 to 135 are attached to the devices 121 to 125, respectively. Note that the identification tags 131 to 135 illustrated in FIG. 2 are large relative to the actual size of the devices 121 to 125, respectively, but in reality, the identification tags 131 to 135 are sufficiently smaller than the devices 121 to 125, respectively.

The reading unit 111 reads the individual identification numbers of the devices 121 to 125 from the identification tags 131 to 135 attached to the devices 121 to 125, respectively. In the case where the identification tags 131 to 135 are wireless tags, the reading unit 111 can read the individual identification numbers of the devices 121 to 125 from a plurality of the identification tags 131 to 135, respectively, at a time by emitting radio waves over a wide range. The reading unit 111 outputs the read individual identification numbers to the condition monitoring unit 112.

The condition monitoring unit 112 has the function of communicating with the devices 121 to 125, and collects data for grasping operating conditions of the devices 121 to 125, that is, first device operation information indicating the operating conditions of the devices 121 to 125. When the condition monitoring unit 112 is installed in a car, a car number of the car is input to the condition monitoring unit 112, so that information on the car number is held in the condition monitoring unit 112. Note that each time the cars are uncoupled for repair, maintenance, or the like in the formation of the train 4 and a train is made up in a new formation, a new car number is input to the condition monitoring unit 112, and information on the car number is held in the condition monitoring unit 112.

The condition monitoring unit 112 operates in conjunction with power supply to the car. When the power to the car is turned on, power is supplied from the car to the condition monitoring unit 112, and the condition monitoring unit 112 supplies power to the reading unit 111. When power is supplied from the condition monitoring unit 112, the reading unit 111 reads the individual identification numbers of the devices 121 to 125 from the identification tags 131 to 135 attached to the devices 121 to 125, respectively. In the case where the devices 121 to 125 are replaced during repair work, maintenance work, or the like, when the power to the car is turned on after the work, the reading unit 111 is supplied with power from the condition monitoring unit 112, and reads the individual identification numbers of the devices 121 to 125 from the identification tags 131 to 135 attached to the devices 121 to 125, respectively.

The condition monitoring unit 112 has a wireless communication function, and communicates with the adjacent condition monitoring unit 112 located on the first car side where the train integrated management device 150 is installed. The condition monitoring unit 112 transmits, to the adjacent condition monitoring unit 112 located on the first car side, the individual identification numbers collected from the reading unit 111, the first device operation information collected from the devices 121 to 125, and the car number held in the condition monitoring unit 112. In the examples of FIGS. 2 and 3, the car 7 to which the device boxes 15 and 16 are attached is defined as the first car, and information is transmitted from the device box 11 toward the device box 16.

When receiving the individual identification numbers, the first device operation information, and the car number from the adjacent condition monitoring unit 112 located on a side opposite to the first car side where the train integrated management device 150 is installed, the condition monitoring unit 112 communicates with the adjacent condition monitoring unit 112 located on the first car side where the train integrated management device 150 is installed. The condition monitoring unit 112 transfers the received individual identification numbers, first device operation information, and car number to the adjacent condition monitoring unit 112 located on the first car side.

The condition monitoring unit 112 connected to the train integrated management device 150 transmits, to the train integrated management device 150, the individual identification numbers collected by itself, the first device operation information, the car number held in the condition monitoring unit 112, and the individual identification numbers, the first device operation information, and the car numbers transferred from the other condition monitoring units 112. In this way, the condition monitoring unit 112 of the car information collection unit 110 transmits the individual identification numbers, the first device operation information, and the car number to the train integrated management device 150 directly or via the condition monitoring unit 112 of another car information collection unit 110. An example in which the condition monitoring unit 112 communicates with another condition monitoring unit 112 has been described, but the present invention is not limited thereto. The condition monitoring unit 112 may transmit the individual identification numbers, the first device operation information, and the car number through a repeater provided for in-train communication with the train integrated management device 150.

The train integrated management device 150 is, for example, a Train Control and Monitoring System (TCMS). The train integrated management device 150 has the function of monitoring and controlling the states of the devices installed in the cars 5 to 7 of the train 4. The train integrated management device 150 constantly performs cable communication or wireless communication with the device to monitor the state of the device and collect second device operation information indicating the operating condition of the device. The content of the second device operation information is different from that of the above-described first device operation information. The second device operation information is necessary for train operation control, and is managed by the train integrated management device 150. Examples of the second device operation information include a control command output by each device and information about feedback on the command. The train integrated management device 150 collects the second device operation information from the condition monitoring unit 112 by a route different from a route by which the first device operation information is acquired. When the train integrated management device 150 acquires the individual identification numbers, the first device operation information, and the car numbers from all the condition monitoring units 112, the train integrated management device 150 transmits, for each device, the individual identification number, device operation information including the first device operation information and the second device operation information, the car number, and a formation number for identifying the train 4 to the ground system 2 via the communication device 160. In addition, the train integrated management device 150 may transmit train speed information and train position information (kilometrage information) in association with a time stamp. Furthermore, the train integrated management device 150 may transmit the train speed information, a train weight, a passenger density, weather-related information such as a temperature in the train and an outside temperature, and the like, as operation auxiliary information, in association with the time stamp. The train integrated management device 150 performs, for example, known compression processing for reducing a data communication volume and known encryption processing for enhancing security, on the information to be transmitted.

The communication device 160 is a device that communicates with the ground system 2. The communication device 160 transmits the information collected by the train integrated management device 150 to the ground system 2. Communication between the information collection apparatus 1, that is, the communication device 160 and the ground system 2 may be wireless communication or cable communication. The wireless communication may be public wireless communication, dedicated line communication, millimeter-wave transmission, or the like.

The information collection apparatus 1 periodically transmits the individual identification numbers, the device operation information, the car numbers, and the formation number to the ground system 2. As a result, the ground system 2 can manage the individual identification numbers, the device operation information, the car numbers, and the formation number in association with each other.

Figure 4:
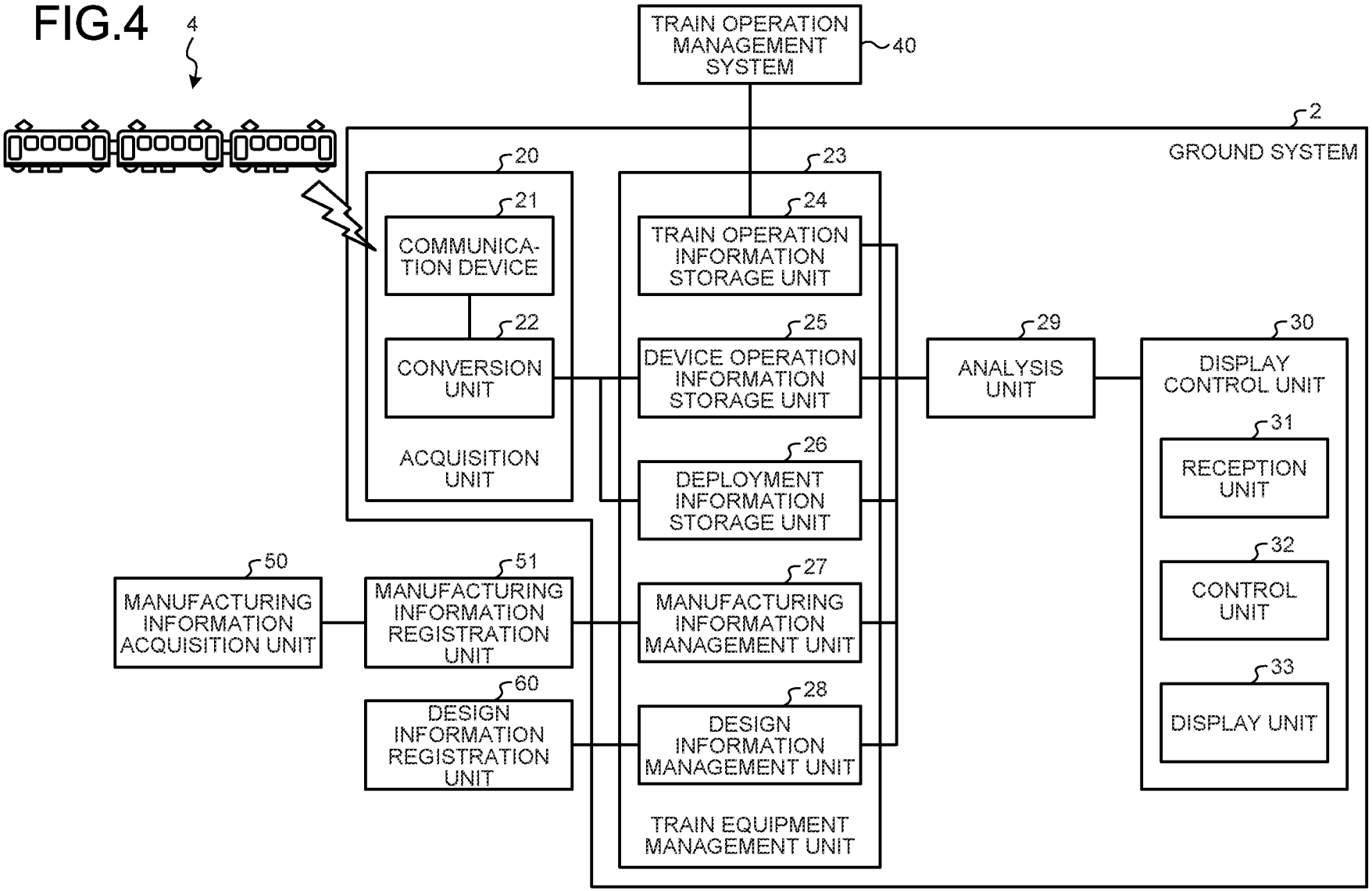
FIG. 4 is a block diagram illustrating a configuration example of a ground system.

The configuration of the ground system 2 will be described. FIG. 4 is a block diagram illustrating a configuration example of the ground system 2 according to the present embodiment. The ground system 2 includes an acquisition unit 20, a train equipment management unit 23, an analysis unit 29, and a display control unit 30. The acquisition unit 20 includes a communication device 21 and a conversion unit 22. The train equipment management unit 23 includes a train operation information storage unit 24, a device operation information storage unit 25, a deployment information management unit 26, a manufacturing information management unit 27, and a design information management unit 28. The display control unit 30 includes a reception unit 31, a control unit 32, and a display unit 33.

The acquisition unit 20 acquires, from the information collection apparatus 1, the information collected by the information collection apparatus 1. Specifically, the acquisition unit 20 acquires, from each train, the individual identification number, the device operation information, the car number, and the formation number for each device installed in each train. The communication device 21 is a device that communicates with the information collection apparatus 1. The communication device 21 receives, from the information collection apparatus 1, the information collected by the information collection apparatus 1. Communication between the information collection apparatus 1 and the ground system 2, that is, the communication device 21 may be wireless communication or cable communication. The wireless communication may be public wireless communication, dedicated line communication, millimeter-wave transmission, or the like. Note that FIG. 4 illustrates the communication device 21 that receives information from the information collection apparatus 1 of the single train 4, but this is an example, and the communication device 21 can receive information from the information collection apparatuses 1 of a plurality of trains.

For example, the conversion unit 22 performs, on the information received by the communication device 21, known decompression processing and known decryption processing corresponding to the compression processing and the encryption processing, respectively, performed by the train integrated management device 150. The conversion unit 22 sorts the acquired information, and outputs the sorted information to the train equipment management unit 23. Specifically, the conversion unit 22 outputs the individual identification numbers, the formation number, and the car numbers to the deployment information management unit 26 of the train equipment management unit 23, and outputs the individual identification numbers and the device operation information to the device operation information storage unit 25 of the train equipment management unit 23.

Figure 5:
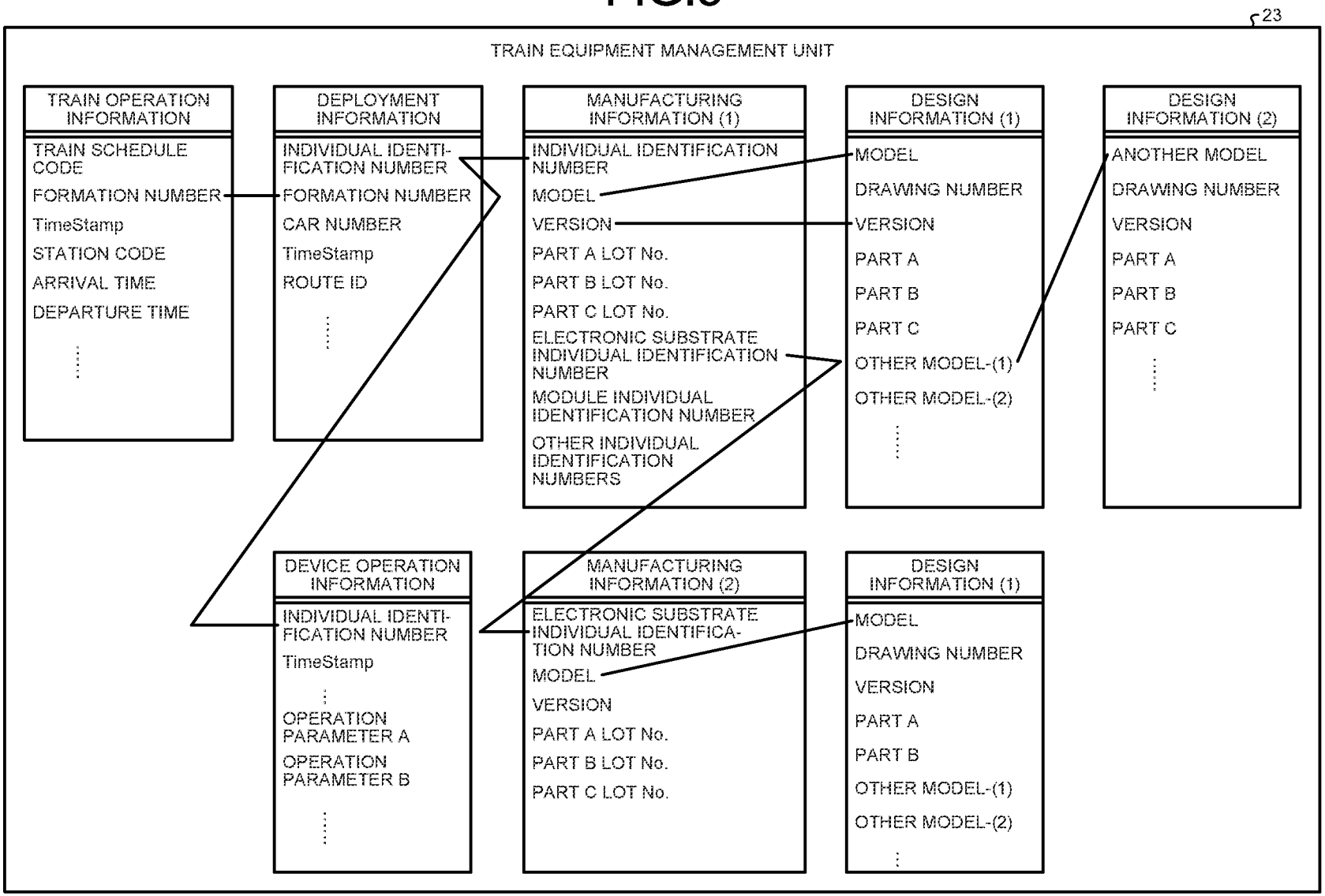
FIG. 5 is a diagram illustrating examples of information to be managed by a train equipment management unit.

The train equipment management unit 23 manages link relationships between the information acquired from the information collection apparatus 1, information on the manufacturing of the device, information on design of the device, train operation information on each train, and the like. For example, the train equipment management unit 23 manages the formation number and the car number in association with the individual identification number of each device, and manages the device operation information in association with the individual identification number of each device. The train equipment management unit 23 manages train operation information that is information indicating the operation history of a train with a formation number. The train equipment management unit 23 manages manufacturing information including a model indicating the type of a device corresponding to an individual identification number and the production histories of parts used to manufacture the device corresponding to the individual identification number, in association with the individual identification number. The train equipment management unit 23 manages design information including information on the types of parts used for a device of a model in association with the model. FIG. 5 is a diagram illustrating examples of information to be managed by the train equipment management unit 23 according to the present embodiment.

The train operation information storage unit 24 acquires train operation information on each train from a train operation management system 40, and stores the train operation information. The train operation information includes information such as a train schedule code for identifying a train schedule that is a train operation plan, a formation number indicating a train to be operated, a time stamp indicating the time of creation of the train operation information, a station code indicating a station where the train arrives and departs in the operation plan, the time when the train arrives at each station, and the time when the train departs from each station. The train operation information storage unit 24 manages the history of the train operation information for each train, that is, each formation number. Note that the time stamp is represented as "TimeStamp" in FIG. 5. The same applies to the subsequent drawings.

The device operation information storage unit 25 stores the device operation information on each device in association with the individual identification number acquired from the information collection apparatus 1. The device operation information includes information such as a time stamp indicating the time when the device operation information was collected by the information collection apparatus 1 and one or more operation parameters which are data indicating the actual operation state of the device. That is, the device operation information storage unit 25 stores the time stamps, the operation parameters, and the like in association with the individual identification numbers.

The deployment information management unit 26 stores, for each device, deployment information on the formation number of a train in which each device is installed, the car number of a car in which each device is installed, and the like. The deployment information includes information such as the formation number, the car number, a time stamp indicating the time when the individual identification number was read, and a route identifier (ID) indicating an operation route of a train in which the device is installed, for each individual identification number. The deployment information management unit 26 manages the history of the correspondence between a device indicated by an individual identification number and a train and a car in which the device is installed.

The manufacturing information management unit 27 stores manufacturing information that is information on the manufacturing of a device. Examples of the manufacturing information include an individual identification number, a model indicating the type of a device indicated by the individual identification number, a version to be changed in the case where, for example, the design of the device is changed or parts for the device are changed, a production lot of each part used, the individual identification number of an electronic substrate used, the individual identification number of a module used, and an other-device individual identification number indicating the individual identification number of a device used for the device indicated by the individual identification number. The manufacturing information management unit 27 manages the relationship between a device to be managed by use of the individual identification number and a device to be managed at a lower level, such as parts used for the device to be managed. The manufacturing information management unit 27 manages constituent elements of a device in a hierarchical structure as in manufacturing information (1) and manufacturing information (2) illustrated in FIG. 5. Note that FIG. 5 illustrates a hierarchical structure with two layers as an example, but the hierarchical structure may have three or more layers. Regarding a method of registering the manufacturing information in the manufacturing information management unit 27, a manufacturing information acquisition unit 50, which is installed in a production line, acquires information on the manufacturing of a device, and registers the acquired information in the manufacturing information management unit 27 via a manufacturing information registration unit 51. In the case of a manually produced device, a producer inputs information on the production of the device to the manufacturing information acquisition unit 50. The manufacturing information acquisition unit 50 registers the information on the production of the device input by the producer, in the manufacturing information management unit 27 via the manufacturing information registration unit 51.

The design information management unit 28 stores design information on each device. For example, the design information includes information such as the model of a device, a drawing number for identifying a design drawing of the device, the version of the device, the types of parts to be used, and the model of another device to be used for the device of the model. The design information management unit 28 manages the relationship between a device to be managed by use of a model and a device to be managed at a lower level, such as the model of another device to be used for the device to be managed. The design information management unit 28 manages constituent elements of a device in a hierarchical structure as in design information (1) and design information (2) illustrated in FIG. 5. Note that FIG. 5 illustrates a hierarchical structure with two layers as an example, but the hierarchical structure may have three or more layers. Regarding a method of registering the design information in the design information management unit 28, a designer inputs the design information to a design information registration unit 60. The design information registration unit 60 registers the design information input by the designer in the design information management unit 28.

As illustrated in FIG. 5, the train operation information and the deployment information are linked by at least the formation number, the deployment information and the device operation information are linked by at least the individual identification number, and the deployment information and the manufacturing information are linked by at least the individual identification number, in the train equipment management unit 23. Furthermore, the manufacturing information and the design information are linked by at least the model and the version, manufacturing information (1) and manufacturing information (2) are linked by at least the parent-child relationship between individual identification numbers, and design information (1) and design information (2) are linked by at least the parent-child relationship between models, in the train equipment management unit 23. In this way, the train equipment management unit 23 manages various types of information in association with each other.

Since the train equipment management unit 23 manages various types of information in association with each other, a user can check the various types of information associated with each other by specifying specific information. The train equipment management unit 23 manages, for example, the individual identification number of a device, the car number of a car in which the device is installed, a formation number, and time information (for example, the time when the individual identification number was read or the time when the individual identification number was received) in association with each other. Therefore, when the user specifies an individual identification number, the train equipment management unit 23 can create device installation history data as the history of trains and cars in which the device with the individual identification number was installed. In addition, the train equipment management unit 23 also manages the train operation information. Therefore, when the user specifies an individual identification number, the train equipment management unit 23 can create the device installation history data and also create train operation information data on a train in which the device was installed from the train operation information by using the formation number and the time information included in the device installation history data. The train equipment management unit 23 receives device operation information on devices from the information collection apparatuses 1 of a plurality of trains, and manages the received device operation information. Thus, when the user specifies an individual identification number, the train equipment management unit 23 can create device operation information history data on the device.

Furthermore, when the user specifies an individual identification number, the train equipment management unit 23 can create train operation/device operation history data on the device by associating the time information of the train operation information data on a train in which the device was installed with the time stamp of the device operation information history data on the device. In addition, the train equipment management unit 23 can include operation auxiliary information in the history data by associating the time information of the train operation information data on a train in which the device was installed with the time stamp of the operation auxiliary information.

Furthermore, the train equipment management unit 23 can register information related to train position information in advance by a user operation. Examples of the information related to a specific train position (kilometrage) include an upward slope, a downward slope, and a curve of a track. The user registers the inclination of the upward slope and the downward slope, and also registers the curve radius of the track and the like for the curve of the track, in the train equipment management unit 23. As a result of registering the information related to a specific train position, the train equipment management unit 23 can create data indicating the relationship between train operation/device operation history data on the device and specific train position information such as an inclination and a curve or the relationship between pieces of device operation information on a plurality of devices of the same type in the specific train position information such as an inclination and a curve.

The analysis unit 29 analyzes the device operation information managed by the train equipment management unit 23. The analysis unit 29 uses the information managed by the train equipment management unit 23 to, for example, estimate deterioration of devices and analyze an impact to be caused when a failure occurs. The analysis unit 29 clusters target data for data analysis based on a condition received from the user such as an individual identification number, a formation number, a train schedule code, a part lot number of a part used at the time of manufacturing, or a model managed by the train equipment management unit 23, or a combination thereof. The analysis unit 29 performs deterioration estimation and impact analysis based on known methods. The analysis unit 29 performs analysis by a known method such as the fault tree analysis (FTA).

The display control unit 30 is a user interface that displays, for example, information relevant to the condition specified by the user among the information managed by the train equipment management unit 23, and the result of analysis performed by the analysis unit 29. The display control unit 30 may be in the form of a Web application to be implemented by a Web browser or the like, or may be in the form of an application to be installed in a personal computer. The reception unit 31 receives an operation to specify, for example, an object to be displayed, such as a device or parts, or a condition from the user. Note that the reception unit 31 may receive a condition for analysis to be performed in the analysis unit 29 from the user. The control unit 32 performs control in such a way as to search the train equipment management unit 23 for information matching the object or condition received by the reception unit 31 and display the information matching the object or condition on the display unit 33. Alternatively, the control unit 32 outputs an analysis condition received by the reception unit 31 to the analysis unit 29. The control unit 32 acquires an analysis result from the analysis unit 29 as a response to the analysis condition. The display unit 33 is a monitor to be used for displaying information under the control of the control unit 32. Note that the reception unit 31 and the display unit 33 may each include a touch panel.

Figure 6:
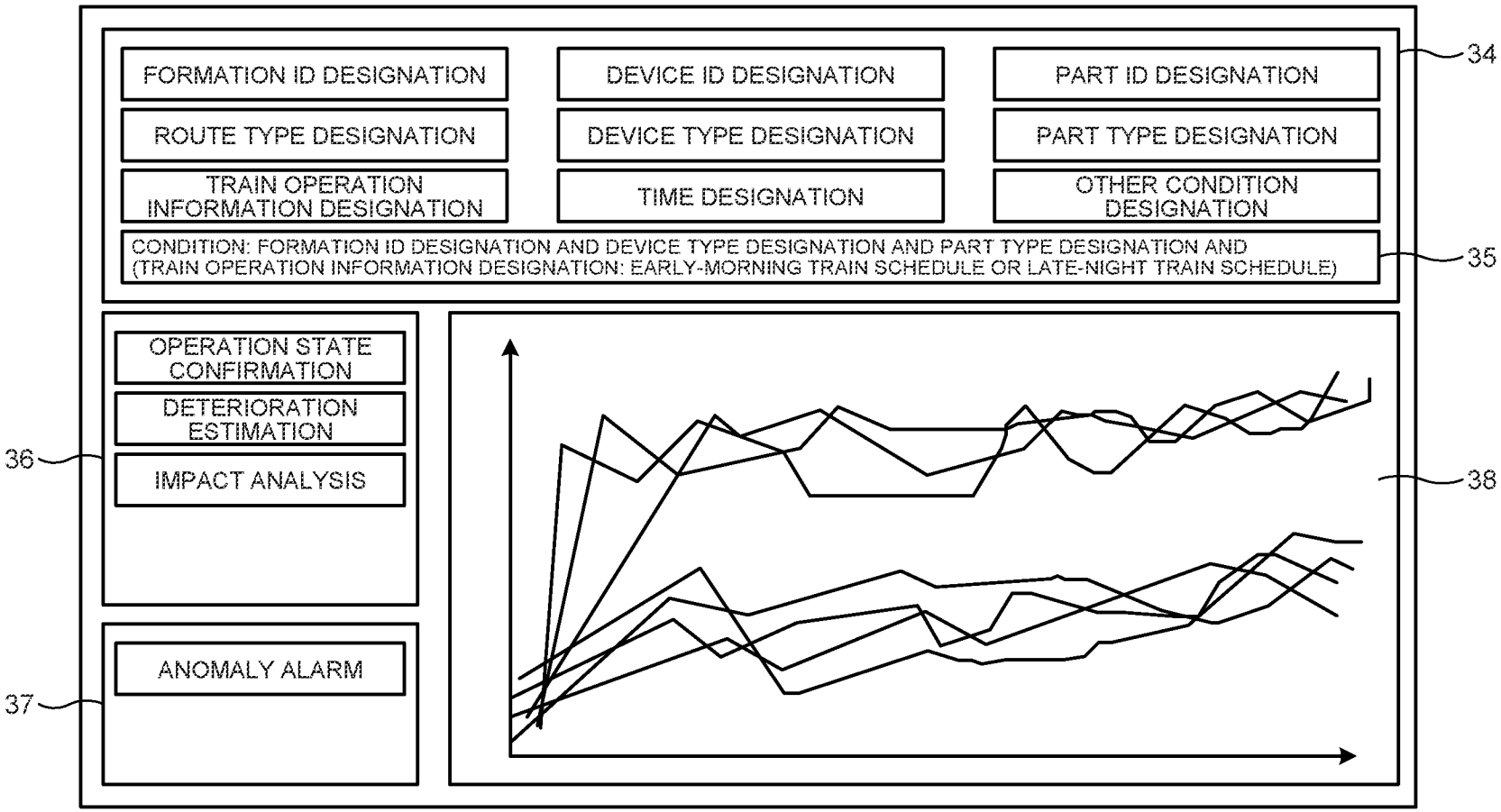
FIG. 6 is a diagram illustrating an example of a screen to be displayed on a display unit of a display control unit.

FIG. 6 is a diagram illustrating an example of a screen to be displayed on the display unit 33 of the display control unit 30 according to the present embodiment. In the display control unit 30, the control unit 32 displays a clustering axis selection area 34, a data analysis axis selection area 36, an incidental information selection area 37, and a graph display area 38 on the display unit 33. The clustering axis selection area 34 includes a clustering axis combination type input area 35.

The reception unit 31 receives an operation from the user by means of the clustering axis selection area 34, the clustering axis combination type input area 35, the data analysis axis selection area 36, and the incidental information selection area 37. The user designates, in the clustering axis selection area 34, information stored in the train equipment management unit 23, that is, information to be displayed in the graph display area 38, so that the reception unit 31 receives the designation from the user. For example, the reception unit 31 receives designation of a formation number through formation ID designation, designation of an individual identification number through device ID designation, and designation of parts used for each device through part ID designation. For example, the parts refer to a part A and the like illustrated in FIG. 5. In addition, the reception unit 31 receives designation of a route ID illustrated in FIG. 5 through route type designation, designation of the model of a device through device type designation, and designation of another model illustrated in FIG. 5 through part type designation. In addition, the reception unit 31 receives designation of a train schedule code illustrated in FIG. 5 through train operation information designation, and designation of time of train operation through time designation. The time of train operation refers to, for example, an early-morning train schedule or a late-night train schedule. In addition, the reception unit 31 receives designation of other items illustrated in FIG. 5, such as a station code and a car number, through other condition designation.

When the user designates a plurality of pieces of information in the clustering axis selection area 34 and the reception unit 31 receives the designation, the reception unit 31 specifies a range of possible values for each piece of information in the clustering axis combination type input area 35 to receive the setting of an OR condition or AND condition for the relationship between the pieces of information. The user designates, in the data analysis axis selection area 36, the purpose of analyzing the information to be displayed in the graph display area 38, so that the reception unit 31 receives the designation from the user. When movement status analysis is specified in the reception unit 31, the control unit 32 outputs a condition specified by the user to the analysis unit 29. The analysis unit 29 searches the train equipment management unit 23 based on the condition acquired from the control unit 32, acquires information from the train equipment management unit 23, and outputs the acquired information to the control unit 32. The control unit 32 performs control in such a way as to display a graph on the display unit 33 by using the information acquired from the analysis unit 29. When deterioration estimation or impact analysis is specified in the reception unit 31, the control unit 32 performs control in such a way as to instruct the analysis unit 29 to perform deterioration estimation or impact analysis based on a condition specified by the user, and display, on the display unit 33, an analysis result that is the result of the deterioration estimation or impact analysis performed by the analysis unit 29. The user chooses, in the incidental information selection area 37, whether to superimpose and display pieces of information on an anomaly and the like that have occurred during train operation in the graph display area 38, the pieces of information being stored in the train operation information storage unit 24 and the device operation information storage unit 25, so that the reception unit 31 receives the choice from the user.

For example, suppose that deterioration of the parts A used in the same devices installed in cars of trains operated on the same route is estimated. In the clustering axis selection area 34, the user designates a desired route through the route type designation, designates a desired device through the device ID designation, and designates the part A through the part ID designation. The reception unit 31 receives the designation of these items, and outputs the received information to the control unit 32. The control unit 32 outputs the information acquired from the reception unit 31 to the analysis unit 29, and instructs the analysis unit 29 to perform deterioration estimation. The analysis unit 29 searches the train equipment management unit 23 based on the information acquired from the control unit 32, acquires information from the train equipment management unit 23, and outputs the information to the control unit 32. The control unit 32 performs control in such a way as to display a graph on the display unit 33 by using the information acquired from the analysis unit 29. As illustrated in FIG. 6, the control unit 32 displays graphs on the display unit 33 by using the acquired multiple pieces of information. Here, assume the case where the graphs displayed in the graph display area 38 can be classified into two tendencies as illustrated in FIG. 6. In order to search for the cause of the different tendencies, the user designates the lot number of the part A included in the manufacturing information through the other condition designation in the clustering axis selection area 34. The reception unit 31 receives the designation, and outputs the received information to the control unit 32. The control unit 32 outputs the information acquired from the reception unit 31 to the analysis unit 29, and instructs the analysis unit 29 to perform deterioration estimation. The analysis unit 29 searches the train equipment management unit 23 based on the information acquired from the control unit 32, acquires information from the train equipment management unit 23, and outputs the information to the control unit 32. The control unit 32 performs control in such a way as to display a graph on the display unit 33 by using the information acquired from the analysis unit 29. The user can check a phenomenon of grouping the loci of the deterioration estimation graphs into devices in which the parts A of lot number (1) are used and devices in which the parts A of lot number (2) are used.

Furthermore, as an example of another use, the user designates an early-morning train schedule, a late-night train schedule, or the like through the train operation information designation in the clustering axis selection area 34. The reception unit 31 receives the designation, and outputs the received information to the control unit 32. The control unit 32 outputs the information acquired from the reception unit 31 to the analysis unit 29, and instructs the analysis unit 29 to perform deterioration estimation. The analysis unit 29 searches the train equipment management unit 23 based on the information acquired from the control unit 32, acquires information from the train equipment management unit 23, and outputs the information to the control unit 32. The control unit 32 performs control in such a way as to display a graph on the display unit 33 by using the information acquired from the analysis unit 29. The user can check a phenomenon of grouping the loci of the deterioration estimation graphs for devices according to the cumulative tendency of the train schedule to which a train formation has been applied.

In addition, as an example of another use, the control unit 32 can also create the installation history or the like of a device. For example, when a desired device is designated through the device ID designation, the control unit 32 can also display formations or cars in which the device was installed in time series by using an individual identification number as a key. The control unit 32 can check the history of the device being removed and installed in a different formation and being removed for maintenance, by creating the installation history of the device. In addition, the control unit 32 can identify a formation number of a train in which the device with the individual identification number is installed, and utilizes the first device operation information on the device in combination with the second device operation information acquired by the train integrated management device of the formation. Furthermore, the control unit 32 can check the train operation information on a train in which the device is installed by designating a formation number (formation ID) and train operation information to create the train operation history of the device.

In this way, even in the case of devices installed in trains that run on the same route, the user can grasp the states of the devices by examining the states of train schedules based on which the trains are operated and individual differences between the devices at the time of manufacturing the devices.

In the case where an anomaly is detected in a device or a part, the user designates impact analysis in the data analysis axis selection area 36 so as to search the range of the impact of the detected anomaly. The case where an anomaly is detected refers to the case where an anomaly is detected in the train integrated management device 150, or the case where in performing deterioration estimation, the analysis unit 29 has detected a device that indicates an operation parameter exceeding a deterioration threshold set for operation parameters of certain device operation information. In the case where the user has designated impact analysis in the data analysis axis selection area 36, the control unit 32 outputs the information acquired from the reception unit 31 to the analysis unit 29, and instructs the analysis unit 29 to perform impact analysis. The analysis unit 29 searches the train equipment management unit 23 based on the information acquired from the control unit 32, acquires information from the train equipment management unit 23, and outputs the information to the control unit 32. The control unit 32 performs control in such a way as to display a graph on the display unit 33 by using the information acquired from the analysis unit 29. As a result, the user can grasp other devices showing the same tendency.

In this way, the ground system 2 manages formation numbers, car numbers, and device operation information in association with individual identification numbers. In addition, the ground system 2 manages train operation information indicating the operation history of a train with a formation number. Furthermore, the ground system 2 manages manufacturing information including a model indicating the type of a device corresponding to an individual identification number and the production histories of parts used at the time of manufacturing the device corresponding to the individual identification number, in association with the individual identification number. In addition, the ground system 2 manages design information including information on the types of parts used in a device of a model in association with the model.

The ground system 2 can analyze device operation information and display an analysis result. In addition, the ground system 2 can display information relevant to conditions specified by the user, among the information managed by the ground system 2. In the case where the ground system 2 has detected any anomaly or deterioration by using items and the like included in the manufacturing information and design information on a device and train operation information, the ground system 2 can detect another device that has the risk of occurrence of the same event. As a result, the user can prevent occurrence of a new anomaly or take prompt action when an anomaly occurs, by using the result of detection performed by the ground system 2.

Figure 7:
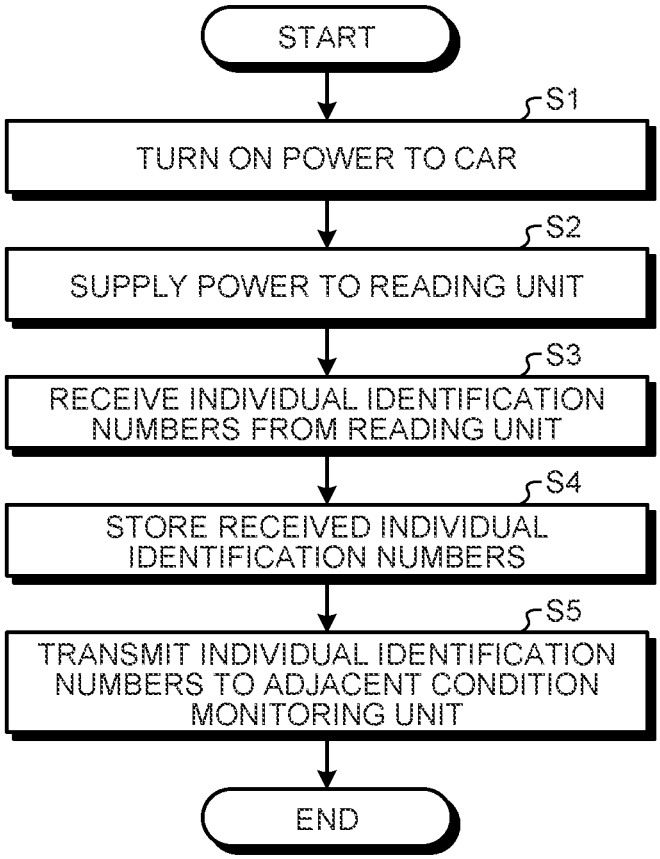
FIG. 7 is a flowchart illustrating operation in which a condition monitoring unit acquires and transmits individual identification numbers.

Operation of each device included in the train equipment management system 3 will be described. FIG. 7 is a flowchart illustrating operation in which the condition monitoring unit 112 according to the present embodiment acquires and transmits individual identification numbers. When the power to a car is turned on (step S1), power is supplied from the car to the condition monitoring unit 112 of the car information collection unit 110, and the condition monitoring unit 112 supplies power to the reading unit 111 connected thereto (step S2). The condition monitoring unit 112 transmits, to the reading unit 111, a read command to read individual identification numbers from identification tags. The reading unit 111 reads an individual identification number from one or more identification tags attached to each device. The condition monitoring unit 112 receives the read individual identification numbers from the reading unit 111 (step S3). The condition monitoring unit 112 stores the received individual identification numbers in a memory (not illustrated) (step S4). The condition monitoring unit 112 transmits the individual identification numbers to the adjacent condition monitoring unit 112 installed in a car included in a train (step S5). In the case where there is a difference between the individual identification numbers received this time and individual identification numbers received the previous time, the condition monitoring unit 112 may transmit, to the adjacent condition monitoring unit 112, only an individual identification number corresponding to the difference. As a result, the condition monitoring unit 112 can reduce the amount of information to be transmitted.

Figure 8:
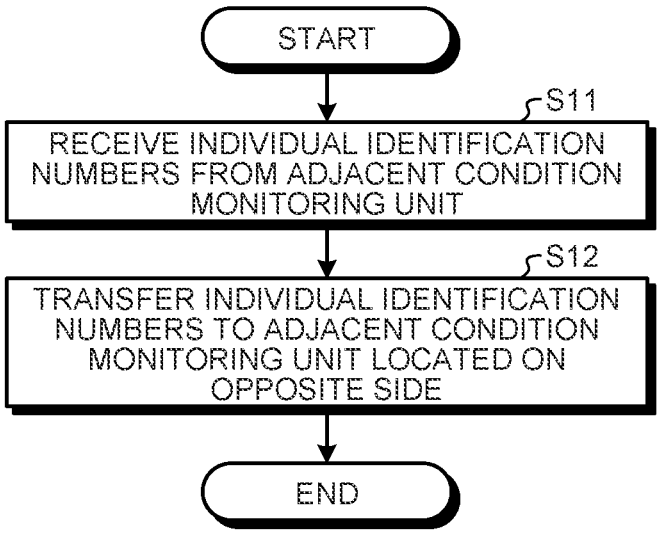
FIG. 8 is a flowchart illustrating operation in which the condition monitoring unit receives individual identification numbers from an adjacent condition monitoring unit and transfers the received individual identification numbers.

FIG. 8 is a flowchart illustrating operation in which the condition monitoring unit 112 according to the present embodiment receives individual identification numbers from the adjacent condition monitoring unit 112 and transfers the received individual identification numbers. The condition monitoring unit 112 receives individual identification numbers from the adjacent condition monitoring unit 112 (step S11). In the case where the condition monitoring unit 112 having received the individual identification numbers is not connected to the train integrated management device 150, the condition monitoring unit 112 transfers the received individual identification numbers to the adjacent condition monitoring unit 112 located on the opposite side (step S12). The condition monitoring unit 112 transfers the individual identification numbers to the condition monitoring unit 112 other than the condition monitoring unit 112 having transmitted the individual identification numbers. It is possible to avoid transferring the individual identification numbers on a circulation route, by transferring the individual identification numbers from the condition monitoring unit 112 to another condition monitoring unit 112 in, for example, descending order of car numbers of cars in which the condition monitoring units 112 are installed. The condition monitoring unit 112 determines a transfer destination by using, for example, an identifier of the condition monitoring unit 112, which will be described below.

Figure 9:
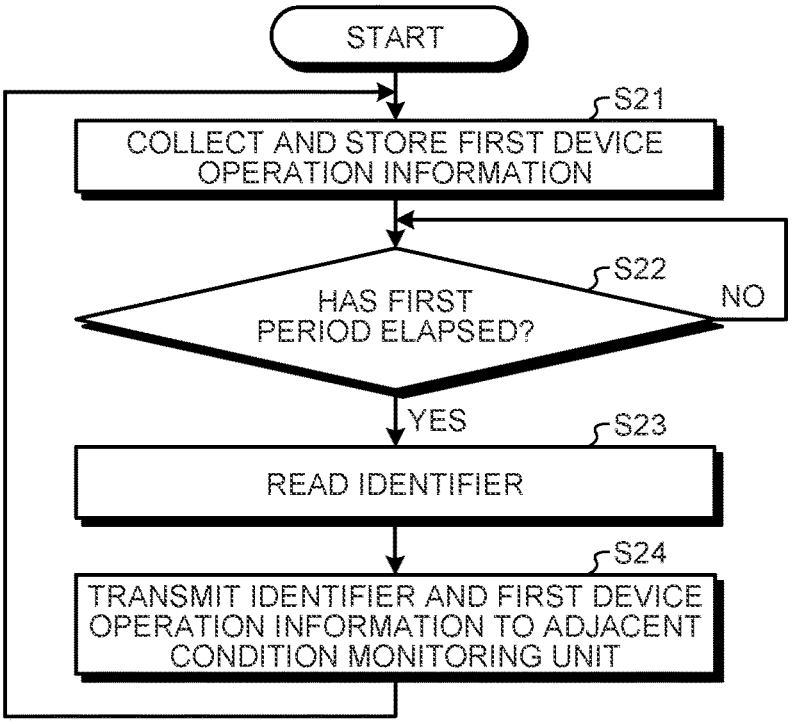
FIG. 9 is a flowchart illustrating operation in which the condition monitoring unit acquires and transmits device operation information.

FIG. 9 is a flowchart illustrating operation in which the condition monitoring unit 112 according to the present embodiment acquires and transmits device operation information. The condition monitoring unit 112 collects first device operation information on a periodic basis, such as at intervals of a millisecond, from a device connected by wired transmission or wireless transmission, and stores the first device operation information in the memory (not illustrated) (step S21). If a first period, which is a processing period for collectively transmitting the first device operation information, has not elapsed (step S22: No), the condition monitoring unit 112 waits until the first period elapses. When the first period has elapsed (step S22: Yes), the condition monitoring unit 112 reads an identifier for identifying the own unit from the memory (step S23). The condition monitoring unit 112 reads the first device operation information from the memory, and transmits its own identifier and the first device operation information to the adjacent condition monitoring unit 112 (step S24). The condition monitoring unit 112 transmits the identifier and the first device operation information to the adjacent condition monitoring unit 112 by the same route as the route of transmission of individual identification numbers.

Figure 10:
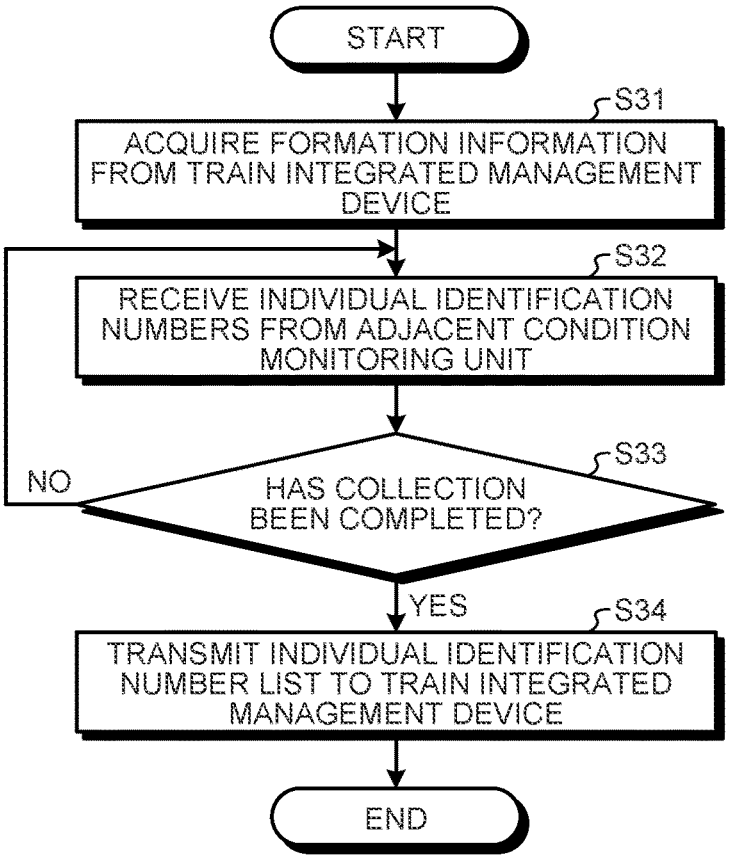
FIG. 10 is a flowchart illustrating operation of the condition monitoring unit connected to a train integrated management device.

FIG. 10 is a flowchart illustrating operation of the condition monitoring unit 112 connected to the train integrated management device 150 according to the present embodiment. The condition monitoring unit 112 connected to the train integrated management device 150 acquires formation information from the train integrated management device 150 (step S31). The formation information includes a list of devices installed in the train, and includes information on the types and number of devices installed in each car. The condition monitoring unit 112 connected to the train integrated management device 150 receives individual identification numbers from the adjacent condition monitoring unit 112 (step S32). If collection of individual identification numbers corresponding to all the devices included in the formation information has not been completed (step S33: No), the condition monitoring unit 112 connected to the train integrated management device 150 returns to step S32, and continues the operation of step S32. When collection of the individual identification numbers corresponding to all the devices included in the formation information has been completed (step S33: Yes), the condition monitoring unit 112 connected to the train integrated management device 150 transmits the collected individual identification numbers as an individual identification number list to the train integrated management device 150 (step S34). At this time, if the condition monitoring unit 112 connected to the train integrated management device 150 cannot receive an individual identification number of any device even after the elapse of a certain period of time, the condition monitoring unit 112 connected to the train integrated management device 150 may determine that the device is out of order and perform time-out processing in which only the received individual identification numbers are transmitted in the form of an individual identification number list to the train integrated management device 150.

Figure 11:
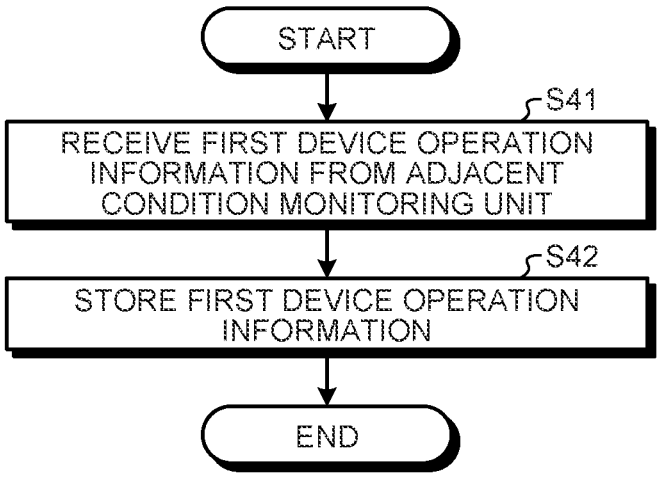
FIG. 11 is a flowchart illustrating operation in which the train integrated management device receives first device operation information.

FIG. 11 is a flowchart illustrating operation in which the train integrated management device 150 according to the present embodiment receives first device operation information. The train integrated management device 150 receives first device operation information from the adjacent condition monitoring unit 112 (step S41). The received first device operation information includes first device operation information collected by the condition monitoring unit 112 connected to the train integrated management device 150, and first device operation information transferred directly or indirectly from the other condition monitoring units 112 to the condition monitoring unit 112 connected to the train integrated management device 150. The train integrated management device 150 stores the received first device operation information in a memory (not illustrated) (step S42). As a result, the first device operation information on the devices installed in the cars 5 to 7 of the train 4 are stored in the memory of the train integrated management device 150 from moment to moment.

Figure 12:
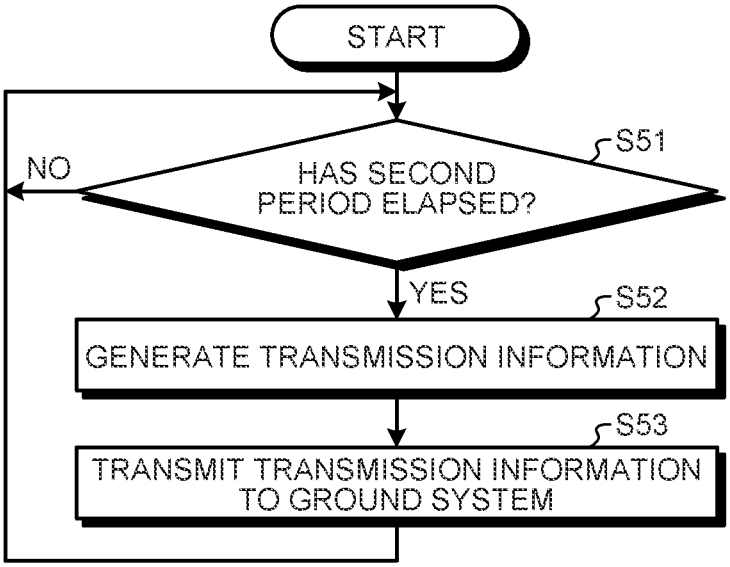
FIG. 12 is a flowchart illustrating operation in which the train integrated management device transmits transmission information including device operation information and the like to a ground system.

FIG. 12 is a flowchart illustrating operation in which the train integrated management device 150 according to the present embodiment transmits transmission information including device operation information and the like to the ground system 2. If a second period, which is a processing period for transmitting acquired information to the ground system 2, has not elapsed (step S51: No), the train integrated management device 150 waits until the second period elapses. When the second period has elapsed (step S51: Yes), the train integrated management device 150 generates transmission information including, for example, an individual identification number, device operation information including the first device operation information and the second device operation information, a car number, a formation number, and a time stamp indicating transmission time, for each device (step S52), and transmits the transmission information to the ground system 2 (step S53). At this time, if the train integrated management device 150 has received the individual identification number list from the condition monitoring unit 112 connected thereto, the train integrated management device 150 transmits the individual identification number list to the ground system 2 only once after the power to the car is turned on.

Figure 13:
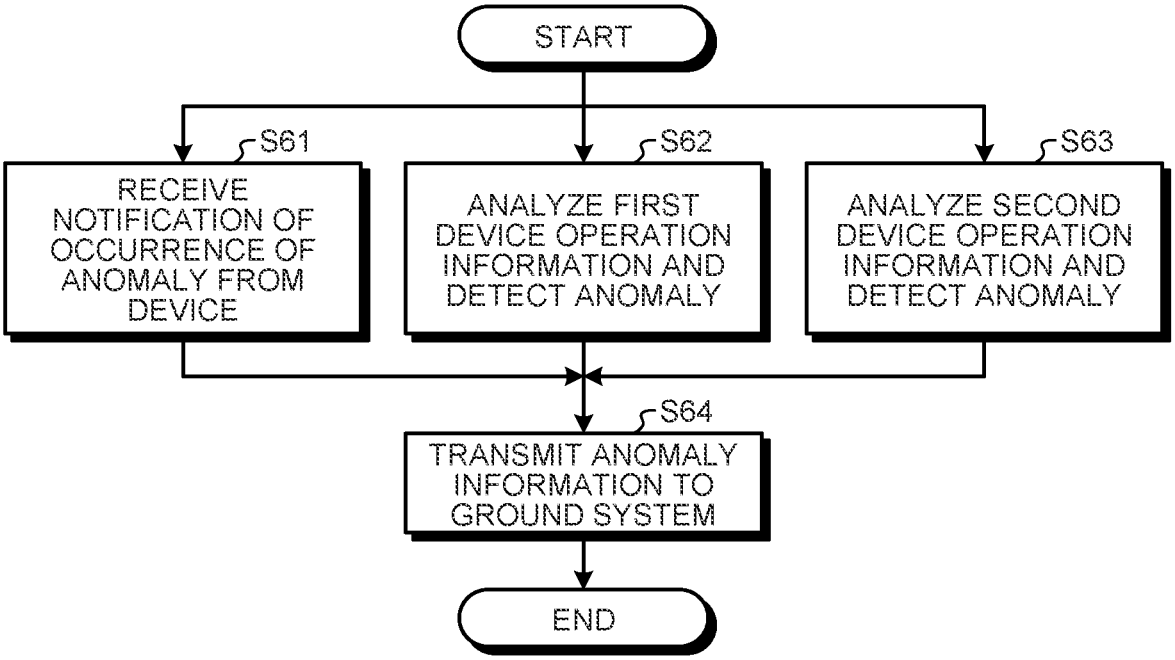
FIG. 13 is a flowchart illustrating operation in which the train integrated management device transmits anomaly information on a device to the ground system.

FIG. 13 is a flowchart illustrating operation in which the train integrated management device 150 according to the present embodiment transmits anomaly information on a device to the ground system 2. When the train integrated management device 150 has received a notification of occurrence of an anomaly from a device (step S61), when the train integrated management device 150 has analyzed the first device operation information acquired from the condition monitoring unit 112 connected thereto to detect an anomaly (step S62), or when the train integrated management device 150 has analyzed the collected second device operation information to detect an anomaly (step S63), the train integrated management device 150 transmits anomaly information to the ground system 2 (step S64). At this time, the train integrated management device 150 may display the detected anomaly on a display unit or the like (not illustrated) of the train integrated management device 150 to notify the user.

Figure 14:
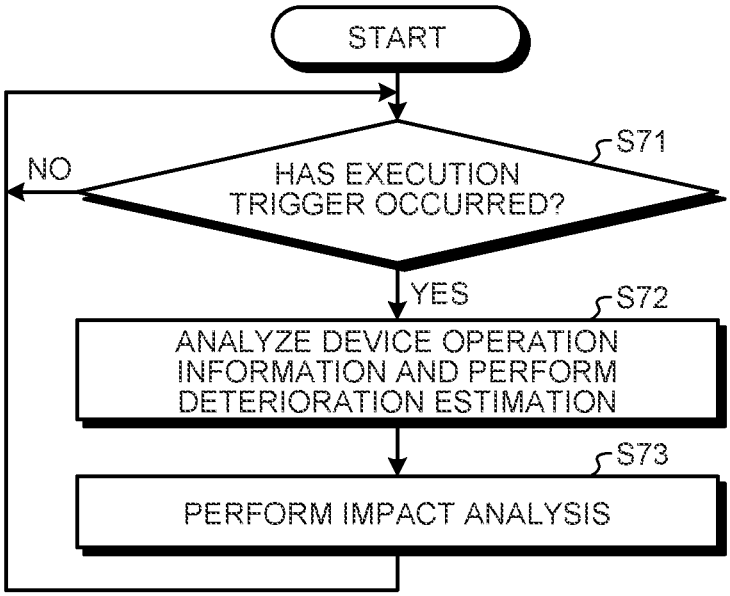
FIG. 14 is a flowchart illustrating a first example of analysis operation to be performed by an analysis unit of the ground system.

FIG. 14 is a flowchart illustrating a first example of analysis operation to be performed by the analysis unit 29 of the ground system 2 according to the present embodiment. When a set execution trigger, such as reference time for daily processing or the like or the time when the power to the train is turned on, has not occurred (step S71: No), the analysis unit 29 waits until the execution trigger occurs. When the execution trigger has occurred (step S71: Yes), the analysis unit 29 analyzes the device operation information, and performs deterioration estimation (step S72). It is not realistic for the analysis unit 29 to constantly estimate deterioration of all the devices. Therefore, the analysis unit 29 performs deterioration estimation for devices such as a device that has been operating for a certain period of time or more, a device installed in a formation that has traveled a certain distance or more, and a device that has not been inspected for a certain period of time or more since the previous inspection. The analysis unit 29 may also perform deterioration estimation for, for example, a device having a high risk for a service level contract for device operation. In the case where the analysis unit 29 has estimated that a device will be deteriorating over time to the extent equivalent to or exceeding a preset threshold, as a result of deterioration estimation, the analysis unit 29 performs impact analysis on the assumption that the same event may also occur in other devices (step S73).

Figure 15:
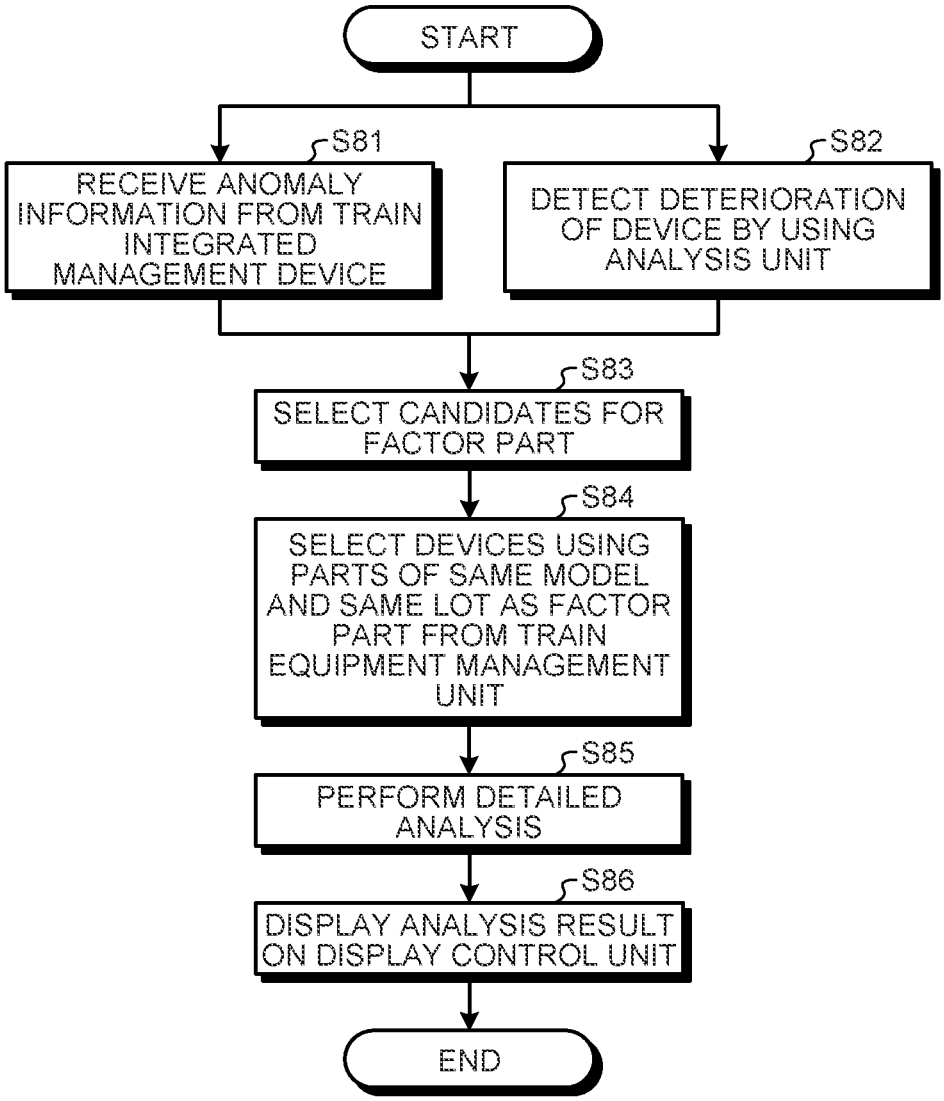
FIG. 15 is a flowchart illustrating a second example of the analysis operation to be performed by the analysis unit of the ground system.

FIG. 15 is a flowchart illustrating a second example of the analysis operation to be performed by the analysis unit 29 of the ground system 2 according to the present embodiment. When the analysis unit 29 has received the anomaly information from the train integrated management device 150 (step S81), or when deterioration of a device estimated in deterioration estimation performed by the analysis unit 29 exceeds the threshold, that is, when the analysis unit 29 has detected such a deterioration of a device (step S82), the analysis unit 29 selects candidates for a factor part that has caused the anomaly or deterioration, by a known method such as FTA (step S83). The analysis unit 29 selects devices that use parts of the same model and same lot as the selected factor part from the train equipment management unit 23 (step S84). Specifically, the analysis unit 29 selects the devices that use parts of the same model and same lot as the selected factor part from the manufacturing information management unit 27, and selects models that use parts of the same model from the design information management unit 28. The analysis unit 29 performs, for the selected devices, detailed analysis of the possibility of occurrence of the same event as that having occurred in the device showing the anomaly or deterioration (step S85). The analysis unit 29 displays, on the display control unit 30, an analysis result showing a value exceeding the threshold or an analysis result showing a normal value if the analysis result indicates a device that shows a sign of anomaly or deterioration and requires attention (step S86). The user checks the analysis result displayed on the display control unit 30. As a result, the ground system 2 can select an individual that is applied to the same part, the same design, or the same route and has a causal relationship in terms of information on design, manufacturing, operation, and the like based on information stored in the train equipment management unit 23 by using the anomaly or deterioration of a single device as a base point. Thus, it is possible to perform predictive maintenance.

Next, the hardware configuration of the information collection apparatus 1 will be described. In the information collection apparatus 1, the train integrated management device 150 is implemented by a computer or the like. The communication device 160 is implemented by a communication interface. The reading unit 111 is a reader that reads information from the identification tag. Some functions of the condition monitoring unit 112 are implemented by a communication interface. The other functions of the condition monitoring unit 112 are implemented by processing circuitry. The processing circuitry may be a memory and a processor that executes a program stored in the memory, or may be dedicated hardware.

Figure 16:
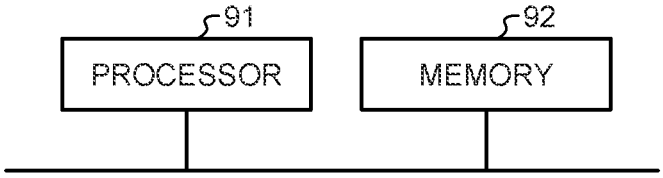
FIG. 16 is a diagram illustrating an example in which processing circuitry included in the information collection apparatus includes a processor and a memory.

FIG. 16 is a diagram illustrating an example in which the processing circuitry included in the information collection apparatus 1 according to the present embodiment includes a processor and a memory. In the case where the processing circuitry includes a processor 91 and a memory 92, each function of the processing circuitry of the information collection apparatus 1 is implemented by software, firmware, or a combination of software and firmware. The software or firmware is described as a program, and stored in the memory 92. The processor 91 reads and executes the program stored in the memory 92 to implement each function in the processing circuitry. That is, the processing circuitry includes the memory 92 for storing programs. As a result of execution of the programs, the information collection apparatus 1 is caused to perform processing. In addition, it can also be said that these programs cause a computer to execute the procedure and method for the information collection apparatus 1.

Here, the processor 91 may be a central processing unit (CPU), a processing device, an arithmetic device, a microprocessor, a microcomputer, a digital signal processor (DSP), or the like. Furthermore, for example, a nonvolatile or volatile semiconductor memory such as a random access memory (RAM), a read only memory (ROM), a flash memory, an erasable programmable ROM (EPROM), or an electrically EPROM (EEPROM) (registered trademark), a magnetic disk, a flexible disk, an optical disk, a compact disk, a mini disk, or a digital versatile disc (DVD) is applicable to the memory 92.

Figure 17:
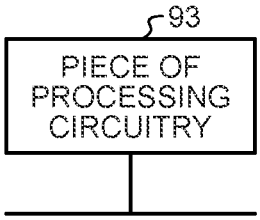
FIG. 17 is a diagram illustrating an example in which the processing circuitry included in the information collection apparatus includes dedicated hardware.

FIG. 17 is a diagram illustrating an example in which the processing circuitry included in the information collection apparatus 1 according to the present embodiment includes dedicated hardware. In the case where the processing circuitry includes dedicated hardware, for example, a single circuit, a composite circuit, a programmed processor, a parallel-programmed processor, an application specific integrated circuit (ASIC), a field programmable gate array (FPGA), or a combination thereof is applicable to a piece of processing circuitry 93 illustrated in FIG. 17. The functions of the information collection apparatus 1 may be separately implemented by the piece of processing circuitry 93, or may be collectively implemented by the piece of processing circuitry 93.

Note that some of the functions of the information collection apparatus 1 may be implemented by dedicated hardware, and some of the other functions thereof may be implemented by software or firmware. Thus, the processing circuitry can implement each of the above-described functions by dedicated hardware, software, firmware, or a combination thereof.

Next, the hardware configuration of the ground system 2 will be described. In the ground system 2, the communication device 21 is implemented by a communication interface. The train equipment management unit 23 is a memory. The reception unit 31 is an input interface. The display unit 33 is a monitor such as a liquid crystal display (LCD). The conversion unit 22, the analysis unit 29, and the control unit 32 are implemented by processing circuitry. As with the above-described processing circuitry of the information collection apparatus 1, the processing circuitry of the ground system 2 may be a memory and a processor that executes a program stored in the memory as illustrated in FIG. 16, or may be dedicated hardware as illustrated in FIG. 17.

As described above, according to the present embodiment, the information collection apparatus 1 installed in the train 4 collects individual identification numbers for identifying devices from identification tags attached to the devices installed in the train 4, collects device operation information indicating the operating condition of each device, and transmits, to the ground system, the individual identification number, the device operation information, a car number for identifying a car in which each device is installed, and a formation number for identifying the train, for each device. As a result, the ground system 2 can manage the usage histories of the devices installed in the train by managing the formation number, the car numbers, and the device operation information in association with the respective individual identification numbers of the devices.

The configurations set forth in the above embodiment show examples of the subject matter of the present invention, and it is possible to combine the configurations with another technique that is publicly known, and is also possible to make omissions and changes to part of the configurations without departing from the gist of the present invention.

REFERENCE SIGNS LIST

1 information collection apparatus; 2 ground system; 3 train equipment management system; 4 train; 5 to 7 car; 11 to 16 device box; 20 acquisition unit; 21, 160 communication device; 22 conversion unit; 23 train equipment management unit; 24 train operation information storage unit; 25 device operation information storage unit; 26 deployment information management unit; 27 manufacturing information management unit; 28 design information management unit; 29 analysis unit; 30 display control unit; 31 reception unit; 32 control unit; 33 display unit; 34 clustering axis selection area; 35 clustering axis combination type input area; 36 data analysis axis selection area; 37 incidental information selection area; 38 graph display area; 40 train operation management system; 50 manufacturing information acquisition unit; 51 manufacturing information registration unit; 60 design information registration unit; 110 car information collection unit; 111 reading unit; 112 condition monitoring unit; 121 to 125 device; 131 to 135 identification tag; 150 train integrated management device.

The invention claimed is:

1. A train equipment management system comprising:

an information collector to collect and transmit an individual identification number for identifying each device installed in a train, device operation information indicating an operating condition of each device, a car number for identifying a car in which each device is installed, and a formation number for identifying the train, to a ground system;

the ground system to manage, in association with the individual identification number of each device, a history of a correspondence between the formation number and the car number, train operation information that is information on a history of train operation for each formation number and the device operation information in association with the individual identification number of each device; and the ground system is configured to, when the individual identification number is specified:

create device installation history data that is a history of trains and cars in which the device with the individual identification number is installed from the history of correspondence, create train operation information data on the train in which a device having the individual identification number is installed based on the train operation history information, and create operation information history of the device having the individual identification number based on the device installation history data and the train operation information.

2. The train equipment management system according to claim 1, wherein the ground system manages train operation information indicating an operation history of the train with the formation number.

3. The train equipment management system according to claim 1, wherein the ground system manages manufacturing information including a model indicating a type of a device corresponding to the individual identification number and production histories of parts used to manufacture the device corresponding to the individual identification number in association with the individual identification number, and manages design information including information on each type of part that is to be used for a device of the model in association with the model.

4. The train equipment management system according to claim 1, wherein the ground system analyzes the device operation information and displays an analysis result.

5. The train equipment management system according to claim 1, wherein the ground system displays information relevant to a condition specified by a user, among the information managed by the ground system.

6. An information collector for constituting the train equipment management system according to claim 1 with the ground system to manage usage histories of devices installed on one or more trains, the information collector comprising:

a car information collector configured to collect an individual identification number for identifying each device installed in a train and first device operation information indicating an operating condition of each device; and a train integrated management device configured to: collect and transmit second device operation information indicating an operating condition of each device being controlled, the individual identification number of each device, device operation information including the first device operation information and the second device operation information, a car number for identifying a car in which each device is installed, and a formation number for identifying the train to a ground system via a communication device for performing a deterioration estimation for installed devices in the train based on at least operation history information associated with the formation number, the first device operation information, and the second device operation information, the operation history information being created based on a device installation history data that is a history of trains and cars in which the device with the individual identification number is installed.

7. The information collector according to claim 6, wherein the car information collector transmits the individual identification numbers and the first device operation information to the train integrated management device directly or via another car information collector.

8. The information collector according to claim 7, wherein the car information collector transmits the first device operation information with a first period, and the train integrated management device transmits, for each device, the individual identification number, the device operation information, the car number, and the formation number to the ground system via the communication device with a second period.

9. A ground system comprising:

an acquirer to acquire collected information from each train, the collected information including an individual identification number for identifying each device installed in the train, device operation information indicating an operating condition of each device, a car number for identifying a car in which each device is installed, and a formation number for identifying the train;

a train equipment controller to manage a history of a correspondence between the formation number and the car number in association with the individual identification number of each device, manage train operation information that is information on a history of train operation for each formation number, and manage the device operation information in association with the individual identification number of each device; and an analysis unit to perform a deterioration estimation for installed devices in the train based on at least operation history information associated with the formation number, the first device operation information, and the second device operation information, wherein when the individual identification number is specified, the train equipment controller creates on a device installation history data that is a history of trains and cars in which the device with the individual identification number is installed from the history of correspondence, create train operation information data on the train in which a device having the individual identification number is installed on the train operation history information, and create operation information history of the device having the individual identification number based on the device installation history data and the train operation information.

10. The ground system according to claim 9, wherein the train equipment controller manages train operation information indicating an operation history of the train with the formation number.

11. The ground system according to claim 9, wherein the train equipment controller manages manufacturing information including a model indicating a type of a device corresponding to the individual identification number and production histories of parts used to manufacture the device corresponding to the individual identification number in association with the individual identification number, and manages design information including information on each type of part that is to be used for a device of the model in association with the model.

12. The ground system according to claim 9, further comprising:

analysis circuitry to analyze the device operation information; and a display to display a result of analysis performed by the analysis circuitry.

13. The ground system according to claim 9, further comprising:

a display to display information relevant to a condition specified by a user, among the information managed by the train equipment controller.

* * * * *